US010704421B2

(12) United States Patent
Mogle, II et al.

(10) Patent No.: US 10,704,421 B2
(45) Date of Patent: Jul. 7, 2020

(54) COMBUSTION LINER TOOL

(71) Applicant: General Electric Company, Schenectady, NY (US)

(72) Inventors: Thomas Alan Mogle, II, Simpsonville, SC (US); Sandra Beverly Kolvick, Simpsonville, SC (US); Troy Lee Smith, Rio Rancho, NM (US)

(73) Assignee: General Electric Company, Schenectady, NY (US)

( * ) Notice: Subject to any disclaimer, the term of this patent is extended or adjusted under 35 U.S.C. 154(b) by 114 days.

(21) Appl. No.: 15/367,863

(22) Filed: Dec. 2, 2016

(65) Prior Publication Data

US 2018/0156071 A1 Jun. 7, 2018

(51) Int. Cl.

| | |
|---|---|
| ***F01D 25/28*** | (2006.01) |
| ***F23R 3/00*** | (2006.01) |
| ***F23R 3/44*** | (2006.01) |
| ***B25B 27/02*** | (2006.01) |
| ***B25B 27/06*** | (2006.01) |

(52) U.S. Cl.

CPC ..... *F01D 25/285* (2013.01); *B25B 27/023* (2013.01); *B25B 27/062* (2013.01); *F23R 3/002* (2013.01); *F23R 3/44* (2013.01); *F05D 2230/70* (2013.01); *F05D 2260/83* (2013.01); *F23R 2900/00017* (2013.01)

(58) Field of Classification Search

CPC .... F23R 3/002; F23R 3/44; F23R 3/60; B25B 27/02; B25B 27/023; B25B 27/062

USPC ..... 29/259, 261, 262, 244

See application file for complete search history.

(56) References Cited

U.S. PATENT DOCUMENTS

| | | | | |
|---|---|---|---|---|
| 1,426,835 | A * | 8/1922 | Mohrman | B25B 27/023 29/259 |
| 1,570,338 | A * | 1/1926 | Davis | B25B 27/062 29/262 |
| 1,599,738 | A * | 9/1926 | Atkins | B25B 27/023 29/261 |

(Continued)

FOREIGN PATENT DOCUMENTS

| | | | |
|---|---|---|---|
| FR | 775861 | A | 1/1935 |
| WO | 2015/156691 | A1 | 10/2015 |

OTHER PUBLICATIONS

Extended European Search Report and Opinion issued in connection with corresponding EP Application No. 17204478.6 dated Apr. 17, 2018.

*Primary Examiner* — Orlando E Aviles
*Assistant Examiner* — Seahee Yoon
(74) *Attorney, Agent, or Firm* — James Pemrick; Hoffman Warnick LLC

(57) ABSTRACT

This disclosure provides tools for installing and removing a combustion liner in a combustion casing. A mounting frame has fasteners positioned circumferentially around an end casing surface of the combustion casing and removably attaches the mounting frame to the combustion casing. A positioning member has pushing surfaces and pulling surfaces distributed circumferentially around the combustion liner. An axial positioning mechanism engages the mounting frame and the positioning member along a common axis. The axial positioning mechanism incrementally positions the positioning member relative to the mounting frame by adjusting a positioning distance between the mounting frame and the positioning member.

12 Claims, 5 Drawing Sheets

(56) References Cited

U.S. PATENT DOCUMENTS 1,650,023 A * 11/1927 Maxwell ..... B25B 27/023 29/262
1,990,570 A * 2/1935 Smith ..... B25B 27/023 29/262
2,052,304 A * 8/1936 Kaplan ..... B25B 27/062 29/262
2,171,910 A * 9/1939 Blackwood, Jr. ..... B25B 27/023 29/261
2,902,751 A * 9/1959 Sommer ..... B25B 27/023 29/261
3,057,052 A * 10/1962 Robertson ..... B25B 27/0028 29/275
3,336,652 A * 8/1967 Ullmo ..... B25D 1/16 29/254
3,691,612 A * 9/1972 Layne ..... B25B 27/062 29/266
3,990,139 A * 11/1976 Touchet ..... B25B 27/023 29/261
4,057,889 A * 11/1977 Ferguson ..... B25B 27/023 29/426.5
4,908,925 A 3/1990 Johnson
5,247,727 A * 9/1993 Harris ..... B01D 63/06 29/259
5,321,875 A * 6/1994 Hoffman ..... B23Q 3/183 29/261
5,983,474 A * 11/1999 Koppe ..... B25B 27/023 29/261
7,003,877 B2 * 2/2006 Reale ..... B25B 27/062 29/259
7,216,409 B1 5/2007 Chiu et al.
7,353,588 B2 4/2008 Crain et al.
7,669,306 B2 3/2010 Palka
8,079,123 B2 12/2011 Lin
8,276,253 B2 * 10/2012 Herbold ..... F23R 3/60 29/256
8,713,776 B2 * 5/2014 Herbold ..... F23R 3/002 29/256
8,782,865 B2 * 7/2014 Gerengi ..... F02C 7/20 29/244
8,814,512 B2 8/2014 Skaustein et al.
2003/0037425 A1 * 2/2003 Sawaya ..... B25B 27/023 29/426.5
2003/0192158 A1 * 10/2003 Reale ..... B25B 27/062 29/235
2008/0178455 A1 * 7/2008 Cox ..... B25B 27/14 29/464
2011/0247193 A1 * 10/2011 Herbold ..... F23R 3/002 29/464
2012/0233845 A1 * 9/2012 Gerengi ..... F01D 25/28 29/466
2015/0083981 A1 3/2015 Kruger
2016/0236336 A1 * 8/2016 Huang ..... B25B 27/062

* cited by examiner

COMBUSTION LINER TOOL

BACKGROUND

The disclosure relates to tools for installing and removing combustion liners of combustors.

Gas turbines typically include a compressor section, a combustion section, and a turbine section. The compressor section pressurizes air flowing into the turbine. The combustion section receives the pressurized air, mixes it with fuel, and combusts the mixture. The turbine section receives the combustion flow from the combustion section to drive the turbine and generate power. The combustion section generally includes one or more combustors disposed around the axis of the gas turbine. Each of the combustors includes a combustion chamber defined by a combustion liner. Combustion occurs in the space within the combustion liner and the combustion liner is generally coated with ceramic materials or other combustion resistant materials.

Combustion liners are routinely removed during combustor maintenance and repair. A significant amount of force can be required to install, remove, and/or re-install the combustion liner within a combustor to overcome the friction at the interface between the combustion liner and the transition piece. For example, a seal is typically disposed at this interface that must be compressed in order to allow the combustion liner to insert into the transition piece. This sometimes requires several hundred pounds of axial installation force and may require a similar magnitude of force for removal. Various approaches have been used for generating this installation force, including manually operated hammers, threaded blocks that moveably engage the combustion liner, and others. Manually hammering and various configurations for engaging the combustion liner can damage combustion liners, particularly ceramic coatings, and may provide less reliable positioning of the combustion liner.

SUMMARY

A first aspect of this disclosure provides a combustion liner tool. The tool comprises a mounting frame, a positioning member, and an axial positioning mechanism. The mounting frame has a central frame axis, a plurality of distal end positions distributed circumferentially at a casing distance from the central member axis, and at least one fastener positioned at the plurality of distal end positions. The positioning member has a central member axis, at least one pushing surface distributed circumferentially at a first sleeve distance from the central member axis, and a plurality of pulling surfaces distributed circumferentially at a second sleeve distance from the central member axis. The axial positioning mechanism engages the mounting frame proximate the central frame axis and the positioning member proximate the central member axis. The axial positioning mechanism incrementally positions the positioning member relative to the mounting frame by adjusting a positioning distance between the mounting frame and the positioning member.

A second aspect of the disclosure provides a tool for installing and removing a combustion liner inside a combustion casing. The tool comprises a mounting frame, a positioning member, and an axial positioning mechanism. The mounting frame has at least one fastener positioned among a plurality of distal end positions distributed circumferentially around an end casing surface of the combustion casing. The at least one fastener removably attaches the mounting frame to the combustion casing. The positioning member has at least one pushing surface distributed circumferentially around an end liner surface of the combustion liner and a plurality of pulling surfaces distributed circumferentially around an exterior liner surface of the combustion liner. The axial positioning mechanism engages the mounting frame and the positioning member along a common axis. The axial positioning mechanism incrementally positions the positioning member relative to the mounting frame by adjusting a positioning distance between the mounting frame and the positioning member.

A third aspect of the disclosure provides a combustion liner tool. The tool comprises a mounting frame, a positioning member, and an axial positioning mechanism. The mounting frame has a first end distal end position with a first fastener and a second distal end position with a second fastener. The positioning member has a central hub and at least three member arms distributed circumferentially around the central hub. Each of the at least three member arms has a pushing surface and a pulling surface. The axial positioning mechanism engages the mounting frame and the positioning member along a common axis. The axial positioning mechanism incrementally positions the positioning member relative to the mounting frame by adjusting a positioning distance between the mounting frame and the positioning member.

The illustrative aspects of the present disclosure are arranged to solve the problems herein described and/or other problems not discussed.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which.

Figure 1:
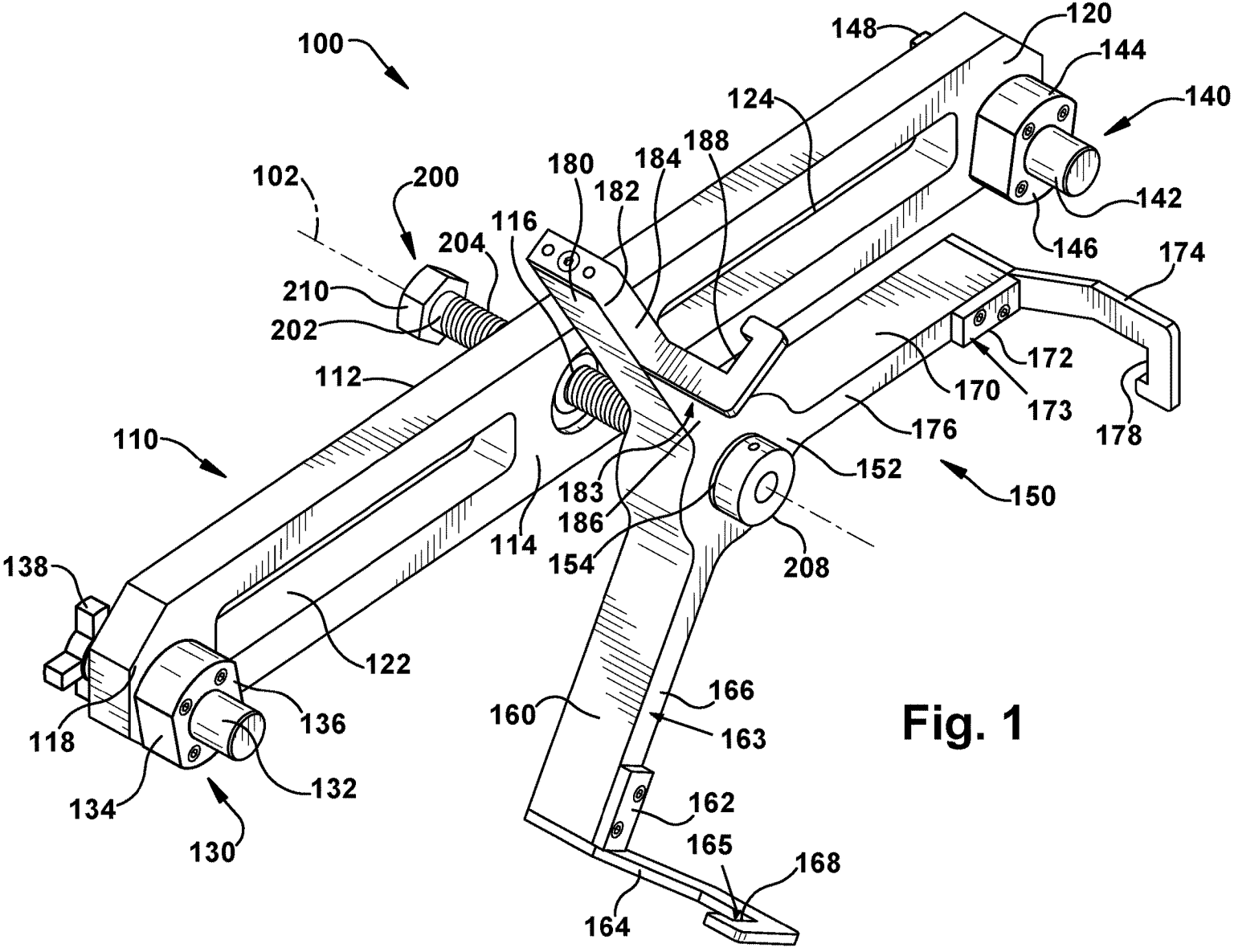
FIG. 1 shows a perspective view of an example combustion liner tool according to various embodiments of the disclosure.

It is noted that the drawings of the disclosure are not necessarily to scale. The drawings are intended to depict only typical aspects of the disclosure, and therefore should not be considered as limiting the scope of the disclosure. In the drawings, like numbering represents like elements between the drawings.

DETAILED DESCRIPTION

In the following description, reference is made to the accompanying drawings that form a part thereof, and in which is shown by way of illustration specific exemplary embodiments in which the present teachings may be practiced. These embodiments are described in sufficient detail to enable those skilled in the art to practice the present teachings and it is to be understood that other embodiments may be used and that changes may be made without departing from the scope of the present teachings. The following description is, therefore, merely illustrative.

Where an element or layer is referred to as being "on," "engaged to," "disengaged from," "connected to" or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

In some embodiments, aspects of the disclosure may be implemented through a tool comprised of a plurality of components made of aluminum, tool-grade medium-carbon steel, titanium, or similar metals. In some embodiments, different components may be made of different materials. Some components may be composed of or coated with other non-metal materials, such as plastic or rubber for pads, pusher blocks, handles, stop hooks, etc. In some embodiments, some components may be forged, cast, machined, printed, or some combination thereof as a single piece and/or welded, bonded, or otherwise permanently joined into a single component. In some embodiments, one or more components may be removably attached to other components with bolts (or other fasteners), mating threads, interference fit, spring pegs, or other mechanical attachments. More specifically, some components may be made in varying dimensions or other interchangeable features to enable the tool to be customized to a specific application, such as machines of varying sizes and the dimensions of the combustion cases and combustion liners.

Figure 2:
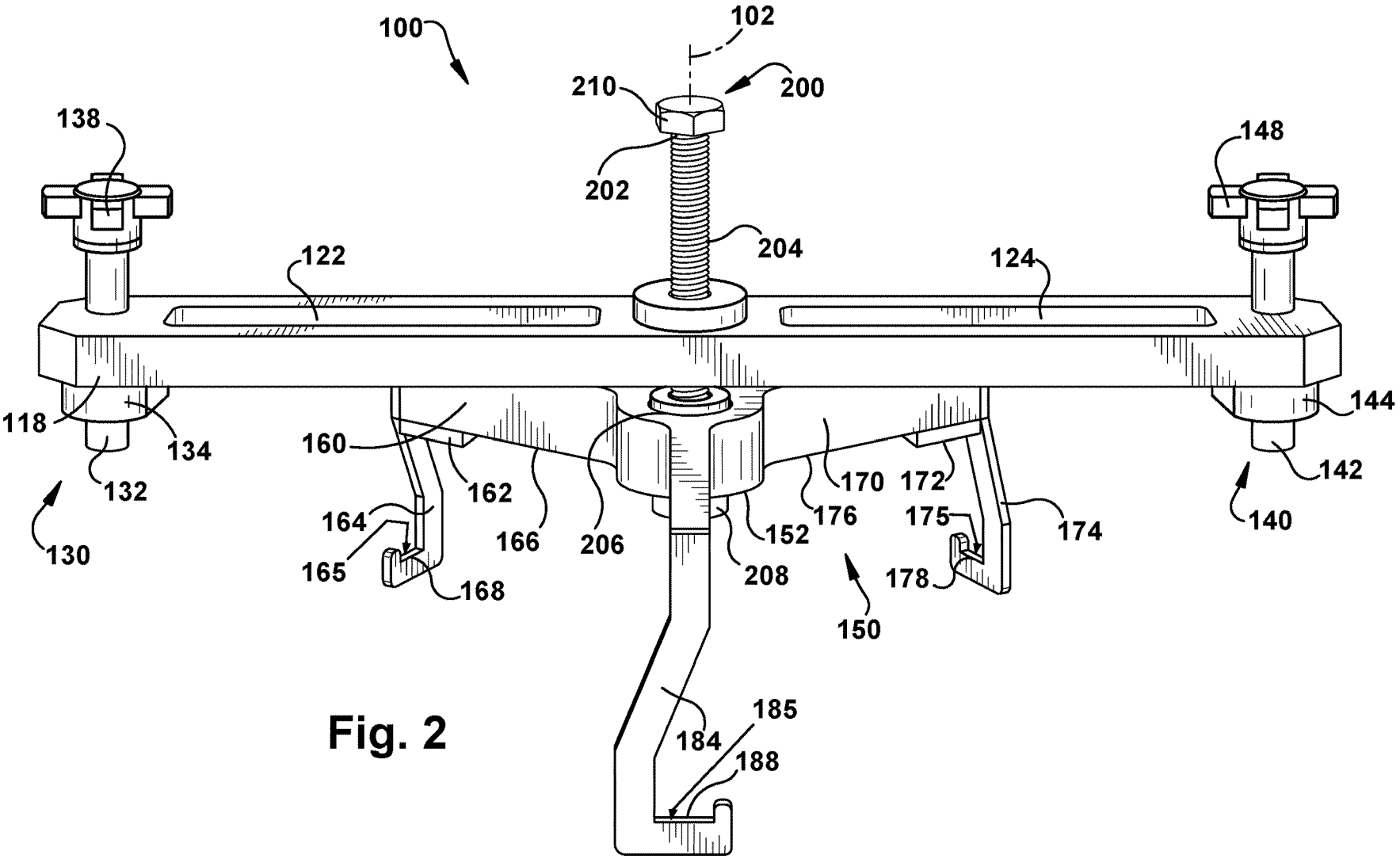
FIG. 2 shows another perspective view of the example combustion liner tool of FIG. 1.

Referring to FIG. 1 and FIG. 2, an example combustion liner tool 100 according to various embodiments is depicted. In the embodiment shown, tool 100 is composed of a mounting frame 110, a positioning member 150, and an axial positioning mechanism 200. Mounting frame 110 may include one or more structural members for spanning an opening in a combustor into which a combustion liner is inserted. Mounting frame 110 may transect the central axis of the generally cylindrical combustion liner and combustion chamber of the combustor and extend to a mounting surface on the combustion casing. Mounting frame 110 may include a plurality of fasteners 130, 140 for removably attaching to the combustion casing. For example, the combustion casing may have a flat annular flange surface surrounding the opening for the combustion liner for receiving a combustion cover assembly. The flange surface may include a plurality of holes for attaching the combustion cover assembly that may provide attachment points for fasteners attached to mounting frame 110 when tool 100 is in use (and the cover is not). Positioning member 150 may include one or more structural members for holding and positioning the combustion liner for installation and removal. Positioning member 150 may include a plurality of member arms 160, 170, 180 each extending from a central hub 152 across and past the outer diameter of the combustion liner. Positioning member 150 may include a pushing interface for engaging the distal end surface of the combustion liner and a pulling interface for engaging the liner stops extending from the outer surface of the combustion liner.

For example, pushing pads 162, 172, 182 may each provide a pushing surface 163, 173, 183 to engage the distal end surface of the combustion liner and liner stop hooks 164, 174, 184 may each provide a pulling surface 165, 175, 185 to engage the liner stops. Axial positioning mechanism 200 connects positioning member 150 to mounting frame 110 along the central axis 102 of tool 100, which generally aligns with the central axis of the combustion liner. Axial positioning mechanism 200 may operate along an axial adjustment member 210 that may be used to adjust the axial spacing between positioning member 150 and mounting frame 110. For example, axial positioning mechanism 200 may be a jack screw with a threaded connection through mounting frame 110 and a fixed rotatable connection to positioning member 150. Turning the jack screw incrementally adjusts the positioning distance between mounting frame 110 and positioning member 150 such that the combustion liner is moved the same distance relative to the combustion casing and the seal for receiving the downstream end of the combustion liner. The environment and use of tool 100 will be further described below with regard to FIGS. 3-5.

In the embodiment shown, mounting frame 110 comprises a mounting bar 112 extending laterally and generally perpendicular to central axis 102. A central portion 114 traverses central axis 102 and provides a positioning interface 116 with axial positioning mechanism 200. Where central portion 114 defines positioning interface 116 and surrounds central axis 102 may be referred to as the central frame axis. Positioning interface 116 may include a threaded interface or other axially adjustable interface for moving axial positioning mechanism 200 along axis 102 through central portion 114. Alternatively, positioning interface 116 may hold mounting frame in a fixed position in the axial direction, while allowing axial positioning mechanism 200 to rotate freely to adjust the relative position of positioning member 150. Mounting bar 112 has a length greater than a span distance to traverse the opening in a combustion casing for receiving the combustion liner, whereby the distal ends 118, 120 extend past the opening and overlap a portion of the combustion casing. The distance from central axis 102 to an attachment surface of the combustion casing with which tool 100 is compatible may be referred to as the casing distance. Mounting bar 112 includes through holes (not visible) proximate distal ends 118, 120 for accommodating fasteners 130, 140. In the embodiment shown, mounting bar 112 also defines bar spaces 122, 124 that are through holes that remove unnecessary weight from mounting bar 112 and provide greater visibility through tool 100. In some embodiments, mounting frame 110 may comprise a plurality of mounting bars or alternate frame shapes for providing more than a single span and two distal ends for overlapping the combustion casing. For example, mounting frame 110 could comprise a tripod, cross, or "H" shape and provide 3-4 distal ends or any number of arms may be possible for providing a plurality of distal ends, preferably at regular spacings around the annular surface. In the embodiment shown, mounting bar 112 is essentially planar, with distal ends 118, 120 in the same plane as central portion 114. In alternate embodiments, central portion 114 may be displaced along central axis 102 to be closer to or farther from the combustion liner by angling or curving mounting bar 112. Fasteners 130, 140 may be configured to engage a hole, flange, or other feature of the combustion casing for removably attaching mounting frame 110 to the combustion casing. Fasteners 130, 140 may be a mechanical fastener, such as bolts (or other threaded fasteners), pegs/keys, expansion caps, clamps/vices, or other mechanical attachments. For example, fasteners 130, 140 may include threaded shafts 132, 142 extending through mounting bar 112 and spacer plates 134, 144 to be threadably coupled to threaded holes in the combustion casing. In another example, fasteners 130, 140 may include threaded shafts to expansion caps or plugs that can be expanded to provide a resistance fit within holes in the combustion casing. In some embodiments, fasteners 130, 140 may not be the same type of fastener. For example, fastener 130 may be a fastener for preventing both axial and rotational movement of mounting bar 112 (e.g., a threaded fastener) and fastener 140 may be a peg or pin that only prevents rotational movement. In some embodiments, spacer plates 134, 144 are comprised of a different material than mounting bar 112 and provide a casing interface surface 136, 146 that engages a surface of the combustion casing and has surface characteristics less likely to damage the combustion casing or generate particulates. In the embodiment shown, spacer plates 134, 144 are attached to mounting bar 112 with a plurality of mechanical fasteners, such as screws, or otherwise bonded to mounting bar 112. In some embodiments, fasteners 130, 140 include hand screw handles 138, 148 to assist a user in manually turning threaded shafts 132, 142 to engage and disengage mounting frame 110 to and from the combustion casing.

In the embodiment shown, positioning member 150 includes central hub 152 surrounding central axis 102 and a plurality of member arms 160, 170, 180 extending laterally from central hub 152 and generally perpendicular to central axis 102. Central hub 152 may be an annular hub with a through hole (not visible) for receiving axial positioning mechanism 200 and defining at least a portion of positioning interface 154. Where central hub 152 defines positioning interface 154 and surrounds central axis 102 may be referred to as the central member axis. Positioning interface 154 may hold positioning member 150 in a fixed position in the axial direction, while allowing axial positioning mechanism 200 to rotate freely to adjust the relative position of mounting frame 110. Alternatively, positioning interface 154 may include a threaded interface or other axially adjustable interface for moving axial positioning mechanism 200 along axis 102 through central hub 152. Member arms 160, 170, 180 may be evenly spaced around a circumference of central hub 152 and extend outward to overlap and extend beyond an exterior circumference of the combustion casing. Member arms 160, 170, 180 may extend to a first liner distance corresponding to the distal surface of the upstream end of the combustion liner and past the first liner distance to a second liner distance corresponding to the exterior circumference of the combustion liner, but less than the distance to the exterior edge of the liner stops. The portions of member arms 160, 170, 180 generally overlapping the distal surface of the combustion liner may define a pushing surface 163, 173, 183 for engaging the distal surface of the combustion liner to apply a pushing force when pushing the combustion liner into the seal at its downstream end. In some embodiments, the pushing surface 163, 173, 183 is a portion of pushing pads 162, 172, 182 generally aligned with the distal surface of the combustion liner on combustion liner facing surfaces 166, 176, 186. For example, pushing pads 162, 172, 182 may be a plastic, rubber, or other polymer material that is shaped (molded, cut, etc.) and adhered or fastened to liner facing surfaces 166, 176, 186. In some embodiments, other materials, including metals or ceramics, may be used so long as they are compatible with generally preserving the surface conditions of the distal surface of the combustion liner. In some embodiments, the pushing surface 163, 173, 183 is made from the same materials as member arms 160, 170, 180 and may be continuous with liner facing surfaces 166, 176, 186 and/or include a coated surface thereof. In some embodiments, member arms 160, 170, 180 may support a continuous annular pushing surface 163, 173, 183, such as a single pushing ring pad with an attachment point to each of member arms 160, 170, 180.

In some embodiments, liner stop hooks 164, 174, 184 may extend from the distal ends of member arms 160, 170, 180 in the axial direction to align with liner stops on the exterior surface of the combustion liner. Liner stop hooks 164, 174, 184 may generally include an extension portion to provide a desired distance or reach from the liner facing surfaces 166, 176, 186 and a hooked portion defining liner stop interface surfaces 168, 178, 188. A plurality of liner stops may be positioned circumferentially around the exterior surface of the combustion liner, generally aligned with one another in the axial direction (equidistant from the distal surface of the upstream end). However, some combustion liners may have liner stop configurations that are unevenly spaced circumferentially, at different axial distances along the surface, or different shapes or sizes. Liner stop hooks 164, 174, 184 may be configured such that they simultaneously engage the plurality of liner stops and may be configured accordingly. For example, the extension portions of liner stop hooks 164, 174, 184 may generally be the same length, the hook portions may define liner stop interface surfaces 168, 178, 188 for engaging with similarly shaped and sized liner stops, and member arms 160, 170, 180 may be regularly spaced and in equal number to the liner stops. Alternatively, the extension portions of liner stop hooks 164, 174, 184 may be of varying lengths and/or include different circumferential offsets, the hook portions may define liner stop interface surfaces 168, 178, 188 for engaging with differently shaped and sized liner stops, and/or member arms 160, 170, 180 may be spaced to match a different configuration of liner stops. In some embodiments, liner stop hooks 164, 174, 184 may be in such number, positions, and interface surface configurations to engage at least a portion of liner stops on a variety of different combustion liner configurations sufficient to apply the necessary force for engaging and pulling the combustion liner, but less than all available liner stops. For example, engaging two liner stops on generally opposed sides of the combustion liner may be sufficient to engage and pull the combustion liner with the tool. Liner stop hooks 164, 174, 184 can be inserted into the gap between the combustion liner and the combustion casing and rotatably engaged to the liner stops. For example, a portion of liner stop hooks 164, 174, 184 may extend past the downstream surface of the liner stops and then be rotated under the downstream surface such that when axial positioning mechanism 200 draws positioning member 150 in the upstream direction, liner stop interface surfaces 168, 178, 188 engage the downstream surfaces of the liner stops. Liner stop hooks 164, 174, 184 may also engage a lateral (in the direction of the circumference of the combustion liner) surface of the liner stops to assist in positioning liner stop hooks 164, 174, 184. For example, liner stop hooks 164, 174, 184 may be inserted in the space between liner stops and then rotated until they contact the liner stops. In some embodiments, liner stop hooks 164, 174, 184 may include a coating or be composed of a material to reduce the chance of damaging liner stops, exterior surface of the combustion liner, or liner facing surface of the combustion casing, should they come into contact. For example, liner stop hooks 164, 174, 184 may be tool steel coated with a polymer coating and attached with fasteners to aluminum member arms 160, 170, 180.

In some embodiments, axial positioning mechanism 200 may movably connect to positioning member 150 at positioning interface 154 and to mounting frame 110 at positioning interface 116. For example, axial positioning mechanism 200 may include an axial shaft 202 extending along axis 102 and passing within through holes in positioning member 150 and mounting frame 110. Axial positioning mechanism 200 may be any mechanical device or arrangement for adjusting the relative distance between mounting frame 110, which may provide a stable position for tool 100 once attached to the combustion casing, and positioning member 150, which may translate any change in distance between mounting frame 110 and positioning member 150 into movement of the combustion liner. For example, a jack screw, telescoping shaft (with hydraulic, pneumatic, or motor control), butterfly jack, or other mechanism for extending or retracting to position positioning member 150. In some embodiments, axial positioning mechanism 200 may be a jack screw. Axial shaft 202 may be a threaded shaft including threads 204 along its length. Axial shaft 202 may pass through mounting frame 110 at positioning interface 116, which includes a complementary threaded interface for moving axial shaft 202 through mounting frame 110 based on rotating motion of axial shaft 202. For example, a threaded nut may be installed in positioning interface 116 and mounted to mounting bar 112 using a shaped flange with fasteners. Axial shaft 202 may also pass through positioning member 150 at positioning interface 154, which includes a non-threaded interface that allows rotation of axial shaft 202 relative to positioning member 150 without changing the fixed axial position of positioning member 150. In some embodiments, positioning interface 154 may include a pinned foot nut 206 above and a pinned end nut 208 below positioning member 150 that retain the axial position of positioning member 150 while it rotates around an annular bushing that separates the through hole in positioning member 150 from axial shaft 202. It may be desirable to provide some frictional resistance to rotation around the bushing to enable positioning member 150 to be rotated with axial shaft 202 until a greater resistance to rotation is encountered, such as when contact is made with the liner stops in the circumferential direction. Once liner stop hooks 164, 174, 184 engage the liner stops by being rotated along the circumference of the combustion liner, positioning interface 154 allows rotation of axial shaft 202 within positioning member 150 as turning axial shaft 202 incrementally adjusts the positioning distance between mounting frame 110 and positioning member 150. In some embodiments, axial shaft 202 may include a turning interface 210, such as a hand or tool interface. For example, turning interface 210 may include an ergonomically shaped hand turning handle or a nut for use with a socket tool (manual or powered).

Figure 3:
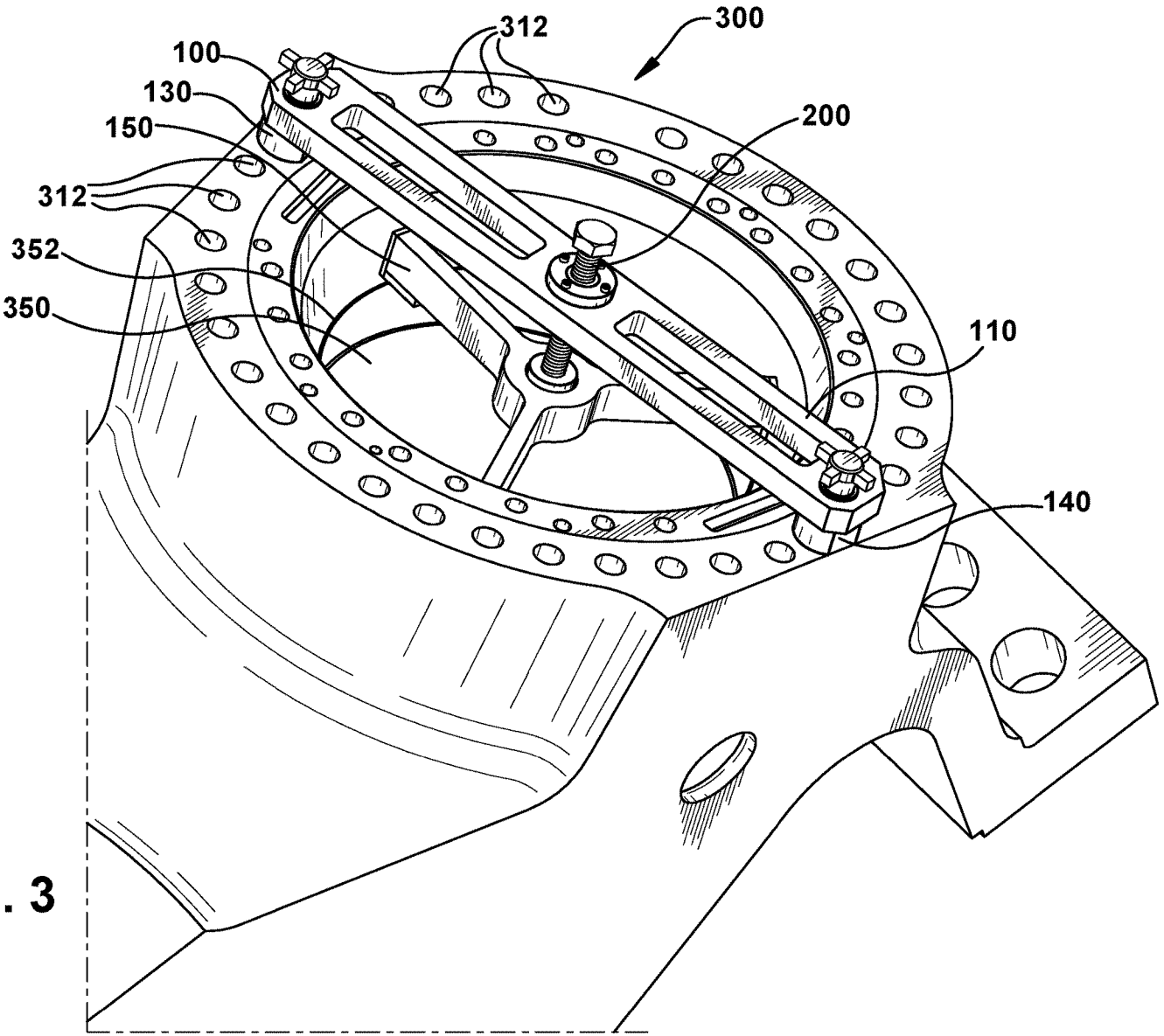
FIG. 3 shows a perspective view of the example combustion liner tool of FIGS. 1 and 2 engaged with a combustion casing and combustion liner.
Figure 4:
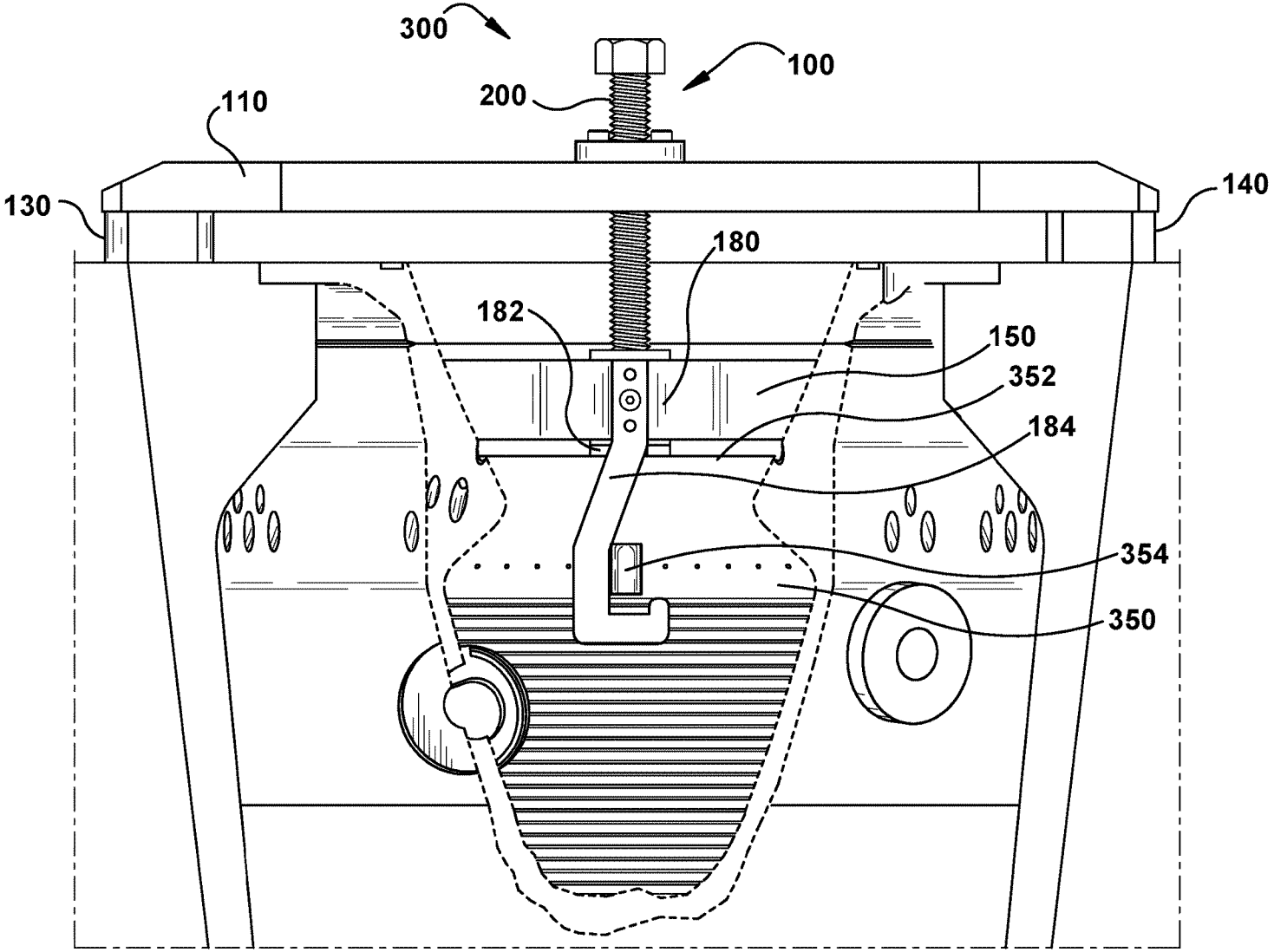
FIG. 4 shows a side view with a partial cutaway to show the example combustion liner tool of FIGS. 1-3 engaged with the combustion liner, according to various embodiments of the disclosure.

Referring to FIG. 3 and FIG. 4, tool 100 is shown in use on an example combustor 300 with a combustion casing 310 and a combustion liner 350. Combustion casing 310 includes a plurality of holes 312 into which fasteners 130, 140 may be attached to secure mounting frame 110 to combustion casing 310. Combustion liner 350 may include a distal surface 352 at the upstream end that may be engaged by positioning member 150. For example, pushing pad 182 on member arm 180 may engage distal surface 352 to push combustion liner 350 into place. Combustion liner 350 may include a plurality of liner stops, such as liner stop 354, that may be engaged by liner stop hooks, such as liner stop hook 184.

Figure 5:
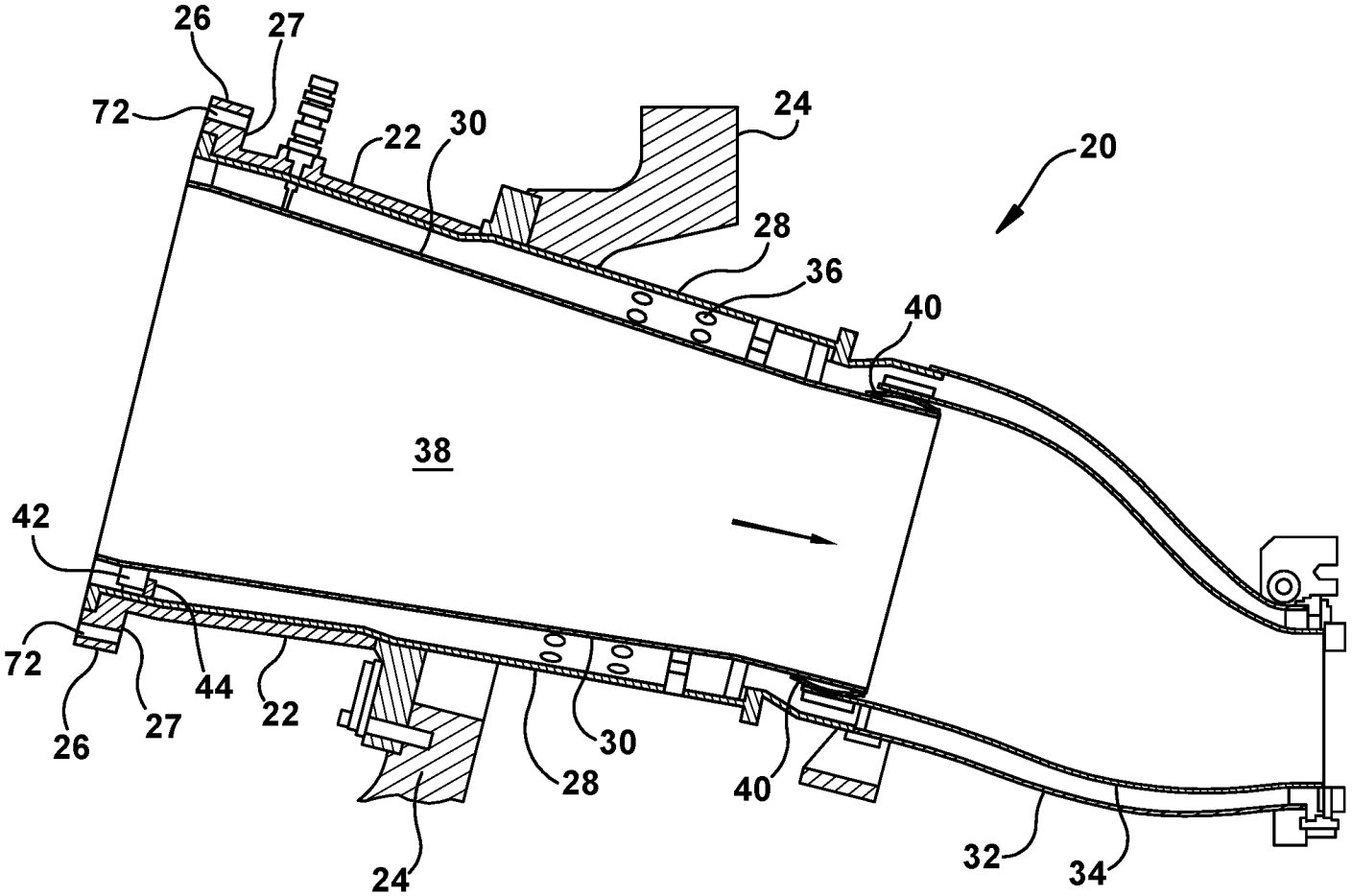
FIG. 5 shows a side cross-sectional view of an example combustor with combustion liner inserted in a combustion casing according to various embodiments of the disclosure.

Referring to FIG. 5, a side cross-sectional view of an example combustor 20, such as a combustor in a turbine assembly for a gas turbine. Combustor 20 may include a substantially cylindrical combustion casing 22 secured to a portion of a gas turbine casing 24, such as a compressor discharge casing or a combustion wrapper casing. A flange 26 may extend outwardly from an upstream end of combustion casing 22. Flange 26 may be configured such that an end cover assembly (not shown) may be secured to combustion casing 22. For example, flange 26 may define a plurality of circumferentially spaced flange holes 72 for attaching the end cover assembly to combustion casing 22. In some embodiments, flange holes 72 may accommodate fasteners from a combustion liner tool, such as combustion liner tool 100, for securing the tool to combustion casing 22. Combustor 20 may also include an internal flow sleeve 28 and a combustion liner 30 substantially concentrically arranged within flow sleeve 28. Both flow sleeve 28 and combustion liner 30 may extend, at their downstream ends, to a double walled transition duct, including an impingement sleeve 32 and a transition piece 34 disposed within impingement sleeve 32. Impingement sleeve 32 and flow sleeve 28 may be provided with a plurality of air supply holes 36 over a portion of their surfaces, thereby permitting pressurized air from the compressor section to enter the radial space between combustion liner 30 and flow sleeve 28. Combustion liner 30 of combustor 20 may define a substantially cylindrical combustion chamber 38, wherein fuel and air are injected and combusted to produce hot gases of combustion. Combustion liner 30 may be coupled at its downstream end to transition piece 34 such that combustion liner 30 and transition piece 34 define a flow path for the hot cases of combustion flowing from each combustor 20 to the turbine section of the turbine assembly. Transition piece 34 may be coupled to the downstream end of combustion liner 30 with a compression or hula seal 40. Hula seal 40 may be disposed at overlapping ends of transition piece 34 and combustion liner 30 to seal the interface between the two components. Hula seal 40 may comprise a circumferential metal seal configured to be spring/compression loaded between inner and outer diameters of mating parts. Installing and removing combustion liner 30 may comprise applying sufficient force to move the downstream end of combustion liner 30 into and through mating contact with hula seal 40 and, thereby require the necessary force to overcome frictional resistance of the spring/compression load and any interference fit.

Combustion liner 30 may also include one or more male liner stops 42 that engage one or more female liner stops 44 secured to flow sleeve 28 or combustion casing 22. Male liner stops 42 may be adapted to slide into the female liner stops 444 as combustion liner 30 is installed within combustor 20 to indicate the proper installation depth of combustion liner 30 as well as prevent rotation of combustion liner 30 during operation of the turbine. Liner stops 42, 44 may ensure proper circumferential alignment of combustion liner 30 within combustor 20. Female liner stops 44 may be substantially "U" shaped and male liner stops 42 may be substantially rectangular in cross-section such that the male liner stops 42 slide into and engage the female liner stops 44. Other configurations are possible, for example, male liner stops may be a different cross-section or disposed on flow sleeve 28 while the female liner stops may be some complementary shape and disposed on the combustion liner.

Generally, when installing combustion liner 30 within combustor 20, combustion liner 30 is initially pushed into combustor 20 by hand. As combustion liner 30 reaches a point where direct hand force limits further installation depth into transition piece 34, a combustion liner tool may be helpful. For example, a significant amount of axial force may be required to compress seal 40 and thereby position combustion liner 30 with respect to transition piece 34. Such axial force may be provided by a combustion liner tool, like tool 100 described above, to ensure that combustion liner 30 is fully installed within combustor 20. Similarly, removal of combustion liner 30 may require a similar but opposite application of axial force to remove combustion liner 30 during maintenance or servicing of combustor 20 and a combustion liner tool may again be helpful.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

What is claimed is:

1. A tool comprising:

a mounting frame having a central axis, the mounting frame including:

a central portion, a positioning interface formed through the central portion, the positioning interface aligned with the central axis, a plurality of distal ends positioned opposite the central portion, and at least one fastener positioned at each of the plurality of distal ends;

an axial positioning mechanism engaging the positioning interface of the mounting frame, the axial positioning mechanism aligned with the central axis of the mounting frame; and a positioning member coupled to the axial positioning mechanism, adjacent the mounting frame, the positioning member including:

a central hub receiving the axial positioning mechanism to couple the positioning member to the axial positioning mechanism, a plurality of member arms extending laterally from the central hub and perpendicular to the central axis, and a plurality of liner stop hooks, each liner stop hook coupled to a corresponding distal end of one of the plurality of member arms, and extending in an axial direction perpendicular to the plurality of member arms, wherein the axial positioning mechanism incrementally adjusts a positioning distance between the mounting frame and the positioning member, and wherein each member arm of the plurality of member arms of the positioning member includes a liner facing surface extending laterally from the central hub, opposite the mounting frame, the liner facing surface formed between the central hub and the distal end of the member arm, and wherein the positioning member further includes a plurality of pushing pads mounted to a corresponding liner facing surface of the plurality of member arms of the positioning member, each of the plurality of pushing pads positioned adjacent a corresponding liner stop hook of the plurality of liner stop hooks.

2. The tool of claim 1, wherein the plurality of distal ends of the mounting frame includes a first distal end with a first through hole formed therethrough, and wherein the at least one fastener includes a first fastener positioned through the first through hole.

3. The tool of claim 2, wherein the first fastener includes a hand screw handle configured to assist a user in manual operation of the first fastener.

4. The tool of claim 1, wherein the axial positioning mechanism is selected from a jack screw, an actuation cylinder, or a scissor jack and includes a power interface selected from a hand screw handle, a pneumatic interface, a hydraulic interface, or an electric motor.

5. A tool for at least one of installing or removing a combustion liner inside a combustion casing, the tool comprising:

a mounting frame having a central axis and including:

a positioning interface formed through the mounting frame and aligned with the central axis, and at least one fastener positioned at a distal end of a plurality of distal ends positioned opposite the positioning interface and overlapping a portion of the combustion casing the at least one fastener removably attaches the mounting frame to the combustion casing;

a positioning member positioned adjacent the mounting frame, the positioning member including:

a central hub, a plurality of member arms extending laterally from the central hub and perpendicular to the central axis, each of the plurality of member arms including a distal end positioned opposite the central hub, and a plurality of liner stop hooks, each liner stop hook coupled to one of the plurality of distal ends of the plurality of member arms, and extending in an axial direction perpendicular to the plurality of member arms, wherein each liner stop hook is oriented to engage a respective liner stop of a plurality of liner stops extending laterally from the combustion liner;

and an axial positioning mechanism coupling the central hub of the positioning member to the positioning interface of the mounting frame, the axial positioning mechanism aligned with the central axis of the mounting frame, wherein the axial positioning mechanism incrementally adjusts a positioning distance between the mounting frame and the positioning member, and wherein each member arm of the plurality of member arms of the positioning member includes a liner facing surface extending laterally from the central hub, opposite the mounting frame, the liner facing surface formed between the central hub and the distal end of the member arm, and wherein the positioning member further includes a plurality of pushing pads mounted to a corresponding liner facing surface of the plurality of member arms of the positioning member, each of the plurality of pushing pads positioned adjacent a corresponding distal end of the plurality of distal ends of the plurality of member arms.

6. The tool of claim 5, wherein the plurality of distal ends of the mounting frame includes a first distal end with a first through hole formed therethrough, and wherein the at least one fastener includes a first fastener positioned through the first through hole into a first receiving hole in the combustion casing.

7. The tool of claim 6, wherein the first fastener includes a hand screw handle configured to assist a user in manual operation of the first fastener.

8. The tool of claim 5, wherein the axial positioning mechanism is selected from a jack screw, an actuation cylinder, or a scissor jack and includes a power interface selected from a hand screw handle, a pneumatic interface, a hydraulic interface, or an electric motor.

9. A tool comprising:

a mounting frame having a central axis;

an axial positioning mechanism engaging and extending through the mounting frame, the axial positioning mechanism aligned with the central axis of the mounting frame; and a positioning member coupled to the axial positioning mechanism, adjacent the mounting frame, the positioning member including:

a central hub receiving the axial positioning mechanism to couple the positioning member to the axial positioning mechanism, at least three member arms distributed circumferentially around the central hub, each of the at least three member arms extending laterally from the central hub and perpendicular to the central axis, each of the at least three member arms including:

a distal end positioned opposite the central hub, and a liner facing surface extending laterally from the central hub, opposite the mounting frame, the liner facing surface formed between the central hub and the distal end of the member arm, and a plurality of liner stop hooks, each liner stop hook coupled to one of the plurality of distal ends of the at least three member arms, and extending in an axial direction perpendicular to the at least three member arms, wherein the axial positioning mechanism incrementally adjusts a positioning distance between the mounting frame and the positioning member, and wherein the positioning member further includes a pushing pad mounted to the liner facing surface of each of the at least three member arms, wherein the pushing pad is positioned adjacent the distal end of each of the at least three member arms.

10. The tool of claim 9, wherein the mounting frame further includes at least one fastener formed on a distal end of the mounting frame, the at least one fastener including a hand screw handle configured to assist a user in manual operation of the at least one fastener.

11. The tool of claim 9, wherein the axial positioning mechanism is selected from a jack screw, an actuation cylinder, or a scissor jack and includes a power interface selected from a hand screw handle, a pneumatic interface, a hydraulic interface, or an electric motor.

12. The tool of claim 9, wherein the axial positioning mechanism is a jack screw with a hand screw handle.

* * * * *